US007364530B2

(12) United States Patent
Lopez

(10) Patent No.: US 7,364,530 B2
(45) Date of Patent: Apr. 29, 2008

(54) WORKOUT APPARATUS

(76) Inventor: Leonard P. Lopez, 5904 Tuscon Dr., The Colony, TX (US) 75056

( * ) Notice: Subject to any disclaimer, the term of this patent is extended or adjusted under 35 U.S.C. 154(b) by 469 days.

(21) Appl. No.: 10/969,395

(22) Filed: Oct. 20, 2004

(65) Prior Publication Data

US 2005/0130806 A1 Jun. 16, 2005

Related U.S. Application Data

(60) Provisional application No. 60/512,627, filed on Oct. 20, 2003.

(51) Int. Cl.
*A63B 1/00* (2006.01)

(52) U.S. Cl. ..... 482/38; 482/35

(58) Field of Classification Search ..... 482/35–38; 472/106, 118; D21/811, 814, 823; 446/487
See application file for complete search history.

(56) References Cited

U.S. PATENT DOCUMENTS 2,817,522 A * 12/1957 Margulies ..... 482/145
3,483,999 A * 12/1969 Barrett ..... 211/204
4,190,283 A * 2/1980 Boucher ..... 297/77

* cited by examiner

*Primary Examiner*—Lori Amerson
(74) *Attorney, Agent, or Firm*—Howison & Arnott, L.L.P.

(57) ABSTRACT

A collapsible workout apparatus is disclosed. The apparatus includes a crossbar member with support legs pivotally attached at each end. The supports legs are operable to pivot outward to a trapezoid shape to form a self-standing structure with the crossbar member substantially parallel to the surface. A protrusion is pivotally attached at the base of each of the support legs. When extended outward, the protrusions also are substantially parallel to the surface. The crossbar member and protrusions, when extended, are operable to enable a user to perform push-ups or pull-ups efficiently. The support legs and protrusions can be pivoted to be substantially parallel to the crossbar member for easy storage and portability.

9 Claims, 6 Drawing Sheets

WORKOUT APPARATUS

CROSS REFERENCE TO RELATED APPLICATIONS

This application claims priority in provisional Application Ser. No. 60/512,627, filed Oct. 20, 2003.

TECHNICAL FIELD OF THE INVENTION

The present invention pertains in general to athletic equipment and, more particularly, to a portable workout device that is collapsible.

BACKGROUND OF THE INVENTION

The desire for individuals to maintain some level of physical fitness has seen an increase in the last one or two decades. Some individuals will pursue a workout regimen in an athletic club which has a great deal of expensive equipment, some equipment being multi-functional in nature and some being associated with only a single function, such as a bench press, dumb bells, etc. However, due to the expense of health clubs, a large number of individuals desire to have the workout equipment in their home. To this end, low cost, portable, multi-functional workout devices have been developed. There are some home use weight machines, for example, that are comprised of a bench and a plurality of rods and the such that can be configured to provide different levels of resistance. These, although being somewhat expensive, are fairly compact and allow an individual the ability to exercise different muscle groups. However, they are complex and expensive and difficult to store. Other types of workout equipment for use by an individual in the home can be very simple. One such workout device is a wheel with two handles on the side which are used to exercise the abdominal muscles.

SUMMARY OF THE INVENTION

The present invention disclosed and claimed herein, in one aspect thereof, comprises a workout apparatus. The apparatus includes a crossbar member, a first pivot device disposed on a first end of the crossbar member, and a second pivot device disposed on a second end of the crossbar member. A first set of support legs is provided that comprises a first downwardly extending leg with one end thereof disposed in the first pivot device and pivotable therein and a second downwardly extending leg having a first end pivotably engaged with the first pivot device. The first and second downwardly extending legs are operable to pivot from a substantially parallel relationship to each other to a non-parallel relationship in a diverging form. A restraining device is provided for restraining the first and second downwardly extending legs from diverging beyond a predetermined point. A second set of support legs is provided that comprises a third downwardly extending leg with one end thereof disposed in the second pivot device and pivotable therein and a fourth downwardly extending leg having a second end pivotably engaged with the second pivot device. The third and fourth downwardly extending legs are operable to pivot from a substantially parallel relationship to each other to a non-parallel relationship in a diverging manner. A restraining device is provided for restraining the first and second downwardly extending legs from diverging beyond a predetermined point. The crossbar member and the first and second set of support legs are structurally load bearing to support the weight of an individual suspended from the crossbar member with the distal ends of the first and second downwardly extending legs of the first and second supporting sets disposed on a flat surface. A first protrusion extends from a pivot point proximate to but disposed a short distance from the end of the first leg of the first set of support legs, the first protrusion operable to pivot upward from a first position that is parallel to the crossbar member to a position that is substantially parallel to the first leg of the first set of support legs. A second protrusion is provided that extends from a pivot point proximate to but disposed a short distance from the end of the third leg of the second set of support legs, the second protrusion operable to pivot upward from a first position that is parallel to the crossbar member to a position that is substantially parallel to the third leg of the second set of support legs. The first and second protrusions in the first position extending toward each other from the respective one of the first and third legs in the respective one of the first and second sets of support legs.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
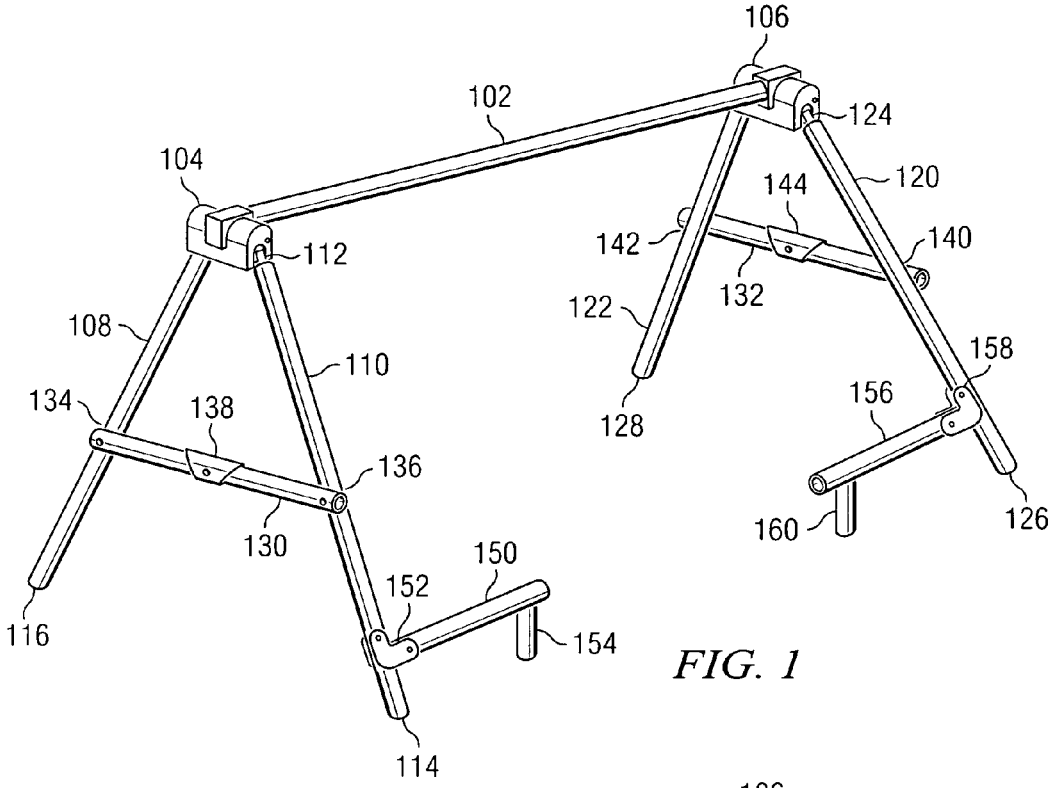
FIG. 1 illustrates a perspective view of the workout apparatus of the present disclosure.

Referring now to the drawings, and more particularly to FIG. 1, there is illustrated a perspective view of the workout apparatus of the present disclosure. There is provided a main cross member 102 that provides the main support structure, as will be described herein below. The cross member 102 has disposed at one end thereof a first pivoting device 104 and at the other end thereof a second pivoting device 106. Pivoting device 106 has associated therewith two downwardly extending legs 108 and 110 which are tubular in shape in the disclosed embodiment, but could be other shapes and configurations. Leg 110 extends from a pivoting end 112 on the pivoting member 104 downward to a foot 114 and member 108 has a foot 116 and extends downward from a pivoting end (not shown). Similarly, pivoting member 106 has two downwardly extending legs 120 and 122, leg 120 having illustrated a pivoting end 124 pivoted in the pivoting member 106 and a foot end 126 associated with the diametrically opposite end thereof. Similarly, the downwardly extending leg member 122 has a foot end 128 associated with the end diametrically opposite to pivoting member 106.

The two downwardly extending legs 108 and 110 and the two downwardly extending legs 120 and 122 are operable to pivot outward to a trapezoid shape such that they provide a self standing apparatus such as a "sawhorse." In this configuration, the two feet 114 and 116 associated with the downwardly extending legs 108 and 110 are at a much farther distance than the two pivoting ends of legs 108 and 110. This is also the case with respect to the downwardly extending legs 120 and 122.

There are provided two cross member braces 130 and 132. Brace 130 is disposed between a point 134 along downwardly extending leg 108 between the two ends thereof and at a point 136 along the length of the downwardly extending leg 110 substantially midway between the two ends thereof. The brace 130 has a locking hinge 138 in the middle thereof such that it can collapse and allow the two downwardly extending leg members 108 and 110 to pivot toward each other. Similarly, the brace 132 is attached to a point 140 along the length of the downwardly extending leg 120 between the two ends thereof substantially midway therebetween and to a point 142 along the length of the downwardly extending leg 122 substantially midway therebetween. A locking hinge 144 is disposed in the middle of the brace 132. The locking members 138 and 144 are pivoting type hinges such that each of the braces 130 and 132 is comprised of two portions that pivot at the associated ones of the locking hinges 138 and 144, which will be described in more detail herein below.

The downwardly extending leg 110 has disposed proximate the end thereof a protruding member 150 that extends from a hinge 152 disposed on a pivot on the surface of the downwardly extending leg 110 outward therefrom and extending toward the interior of the workout apparatus and disposed, when erected, substantially parallel to the work surface of the floor on which the apparatus is disposed. There is provided a support member 154 that supports the distal end of the protruding member 150 above the surface of the floor to support weight. Similarly, there is a protruding member 156 that protrudes from a pivoting point on the distal end of the downwardly extending leg 120 proximate the foot 126 which protrudes outward therefrom toward the center of the workout apparatus along and parallel to the plane that is formed by the cross member 102, the downwardly extending leg 110 and the downwardly extending leg 120. It is disposed parallel to the floor surface and pivoted by a hinge 158 on the downwardly extending leg 120. A support member 160, similar to the support member 154, extends downward from the protruding member 156 on the distal end thereof relative to the hinge 158.

The workout apparatus, when assembled, will have a height that is approximately three to four feet. It is at a height such that an individual can lay under the workout apparatus and extend their arms upwards to grab the support member 102 such that they can pull themselves up. By using this configuration, an individual can work certain muscles with less strain than a straight pull-up which involves an overhead bar. The individual can then face downward to the floor and place one hand on the protruding member 150 and the other hand on the protruding member 156, such that the legs of the individual extend in either direction from the workout apparatus. The dimensions of the workout apparatus are such that the individual can place their hands at approximately the width of their shoulders or slightly closer together. It is noted that the two distal ends of the protruding members 150 and 156 do not touch in this described embodiment, or are not connected together. Therefore, the individual can do push-ups or they can do pull-ups with very little effort other than turning their body. This allows for a very efficient workout.

Figure 2A:
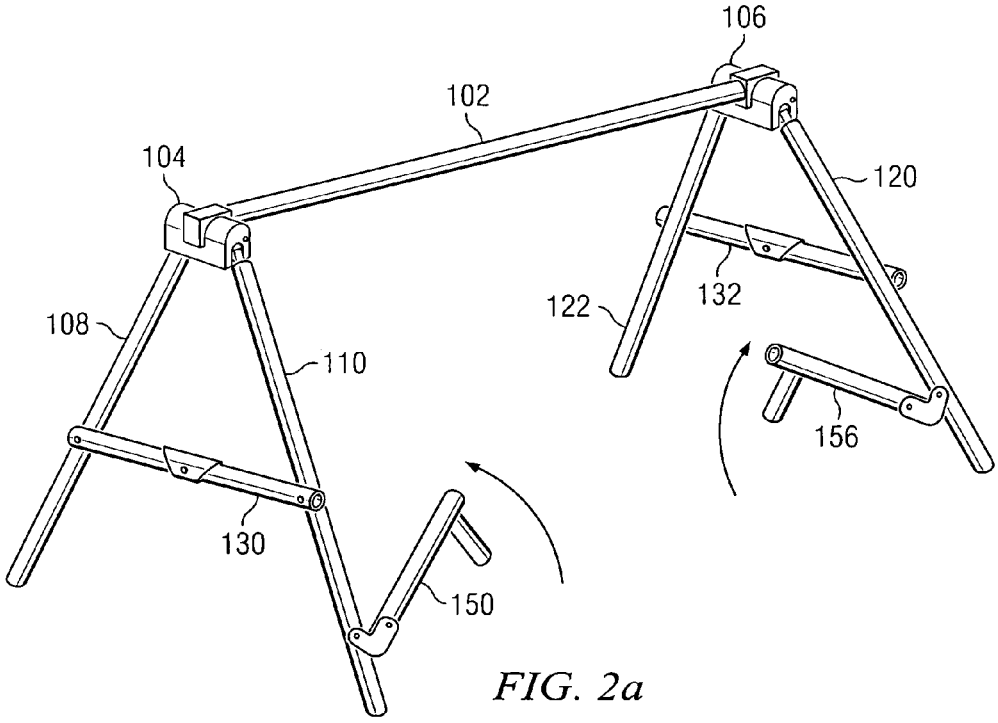
FIGS. 2*a*-2*c* illustrate the multiple steps required to collapse the workout apparatus into a compact configuration.
Figure 2B:
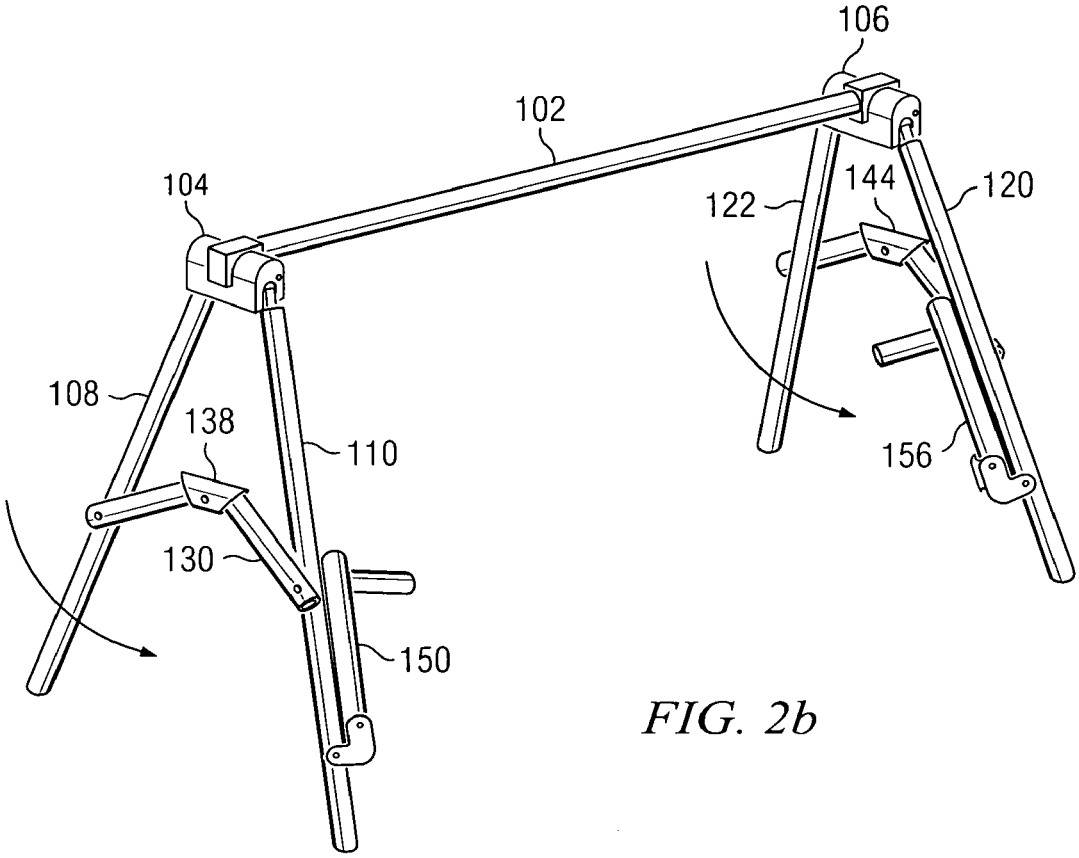
Figure 2C:
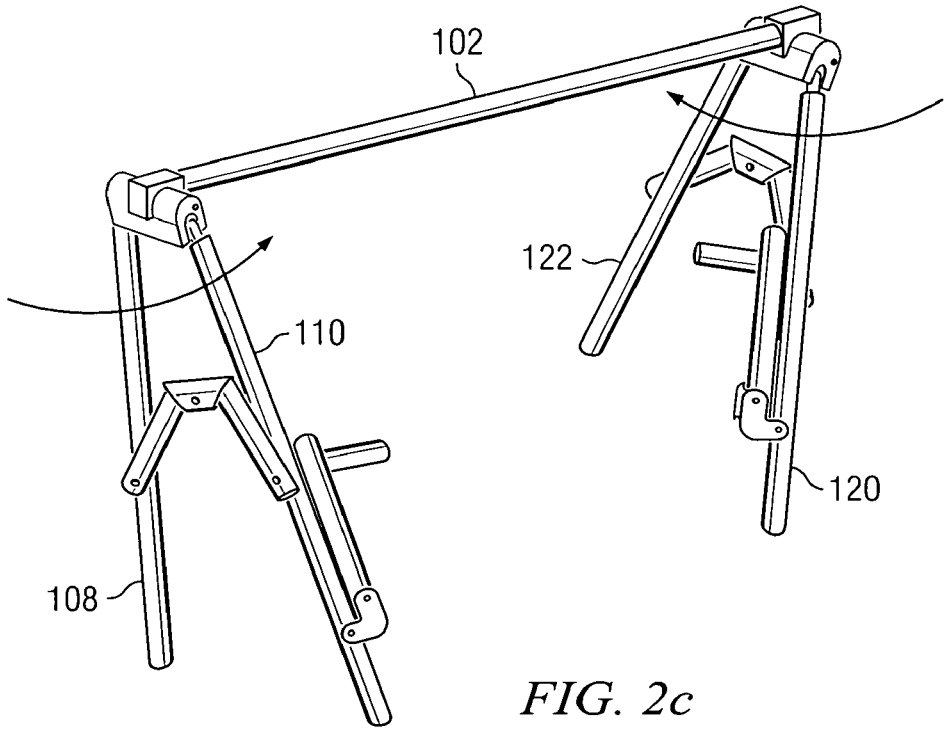

Referring now to FIGS. 2*a*-2*c*, there is illustrated a diagrammatic view of how the workout apparatus collapses. With specific reference to FIG. 2*a*, it can be seen that the first step of collapsing the workout apparatus is to pivot protruding members 150 and 156 upwards such that they are substantially parallel with respect to the downwardly extending legs 110 and 120. The next step, illustrated in FIG. 2*b*, is to push upward on the locking hinges 138 and 144 to pull the downwardly extending legs 110 and 108 toward each other and the downwardly extending legs 120 and 122 toward each other. The next step, illustrated in FIG. 2*c*, is to move the collapsible legs 120 and 122 toward the cross member 102 and the collapsed legs 108 and 110 toward the cross member 102, such that they are substantially parallel thereto. This provides a very compact workout apparatus that can be stored in a storage bag or the such.

Figure 3A:
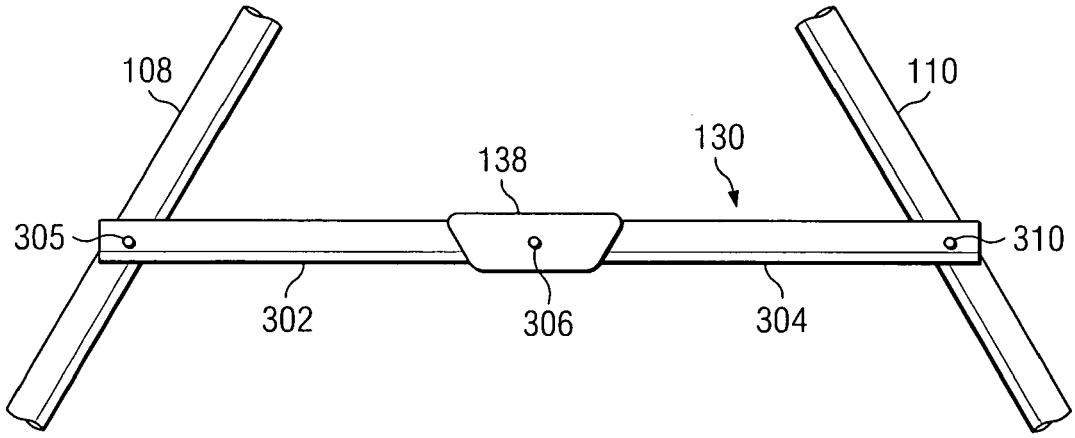
FIGS. 3*a* and 3*b* illustrate a detail of a collapsing crossbar.
Figure 3B:
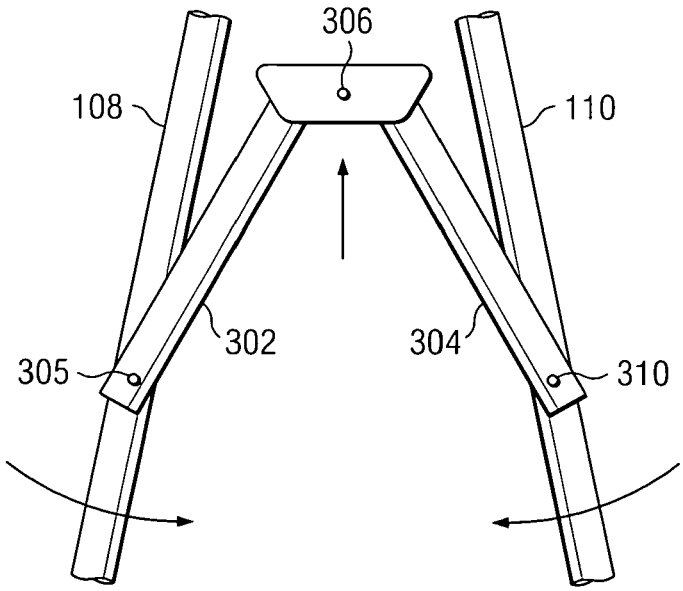

Referring now to FIG. 3*a* and 3*b*, there is illustrated a diagrammatic view of the brace 130 and the locking hinge 138. The downwardly extending legs 108 and 110, the cross member 102 and the protruding members 150 and 156, as well as the downwardly extending support members 154 and 160, can be fabricated from different materials or from the same material. A typical material could be a lightweight tubular aluminum which would provide both the light weight and the strength. However, a plastic such as polycarbonate could also be utilized, although this may bend more than desirable. Although round tubes are illustrated, other shapes could also be utilized. Any type of extruded metal or other material would also be useful.

The brace 130 is fabricated from a first member 302 and a second member 304. Member 302 is pivoted at one end with a pivot pin 305 to the outside of the downwardly extending leg 108 and then to a pivot pin 306 on the locking hinge 138. Similarly, the member 304 is pivoted on one end with a pivot pin 310 to the downwardly extending leg 110 and to the pivot pin 306.

FIG. 3*b* illustrates that, when an upwardly directed force is directed toward the bottom of the locking hinge 138, it will allow the two members 302 and 304 to pivot about the center pivot 306 such that the two downwardly extending legs 108 and 110 can be pushed together. The members 302 and 304 are typically of a flat bar stock and disposing outside of the plane of the apparatus such that, when the two downwardly extending legs 108 and 110 are touching each other, the bottom surfaces of the members 302 and 304 are adjacent each other and do not interfere with the two surfaces of the downwardly extending legs 108 and 110 touching each other. However, members 302 and 304 could be tubular and could be disposed in such a manner that they are in the same plane as the legs 408 and 110.

Figure 4A:
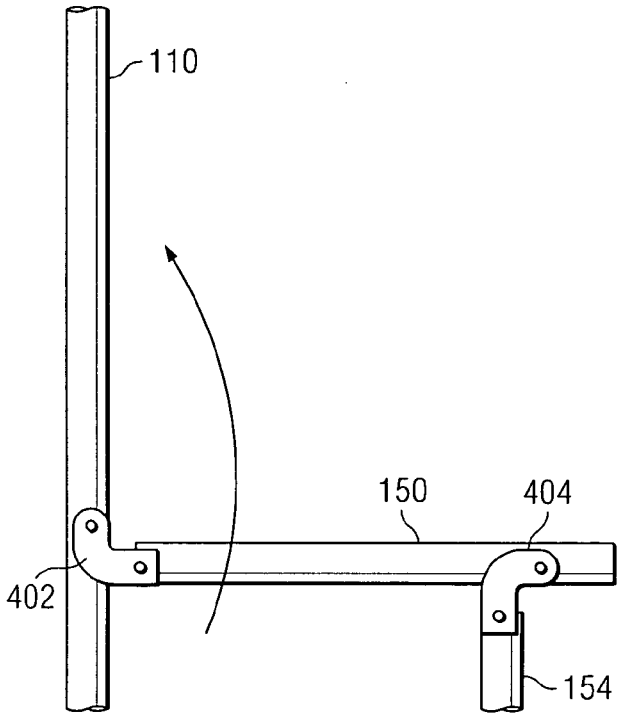
FIGS. 4*a*-4*d* illustrate a detail of the collapsing end portion.
Figure 4B:
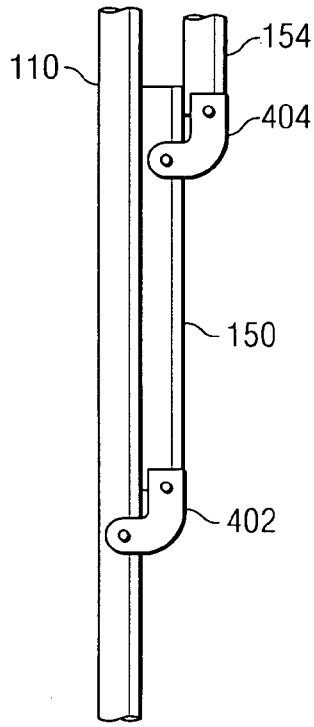

Referring now to FIGS. 4*a*-4*d*, there is illustrated a detail of the manner in which the protruding members 150 and 156 are pivoted. Illustrated in FIGS. 4*a* and 4*b* is only the protruding member 150. The protruding member 150 is connected to the downwardly extending leg 110 with a hinge 402 and the downwardly extending support member 154 is connected to the protruding member 150 with a hinge 404. The hinge 402 is configured such that, when it is rotated, the protruding member 150 will swing up parallel to the downwardly extending leg member 110. The downwardly extending support member 154 will pivot outward parallel to the protruding member 150. This is illustrated in FIG. 4*b* and, as such, when the protruding member 150 is pivoted downward, the hinge 402 will have a stop that will substantially prevent it from pivoting downward further, but the primary force is maintained on the support member 154, the hinge 404 bearing the weight on the edge thereof.

Figure 4C:
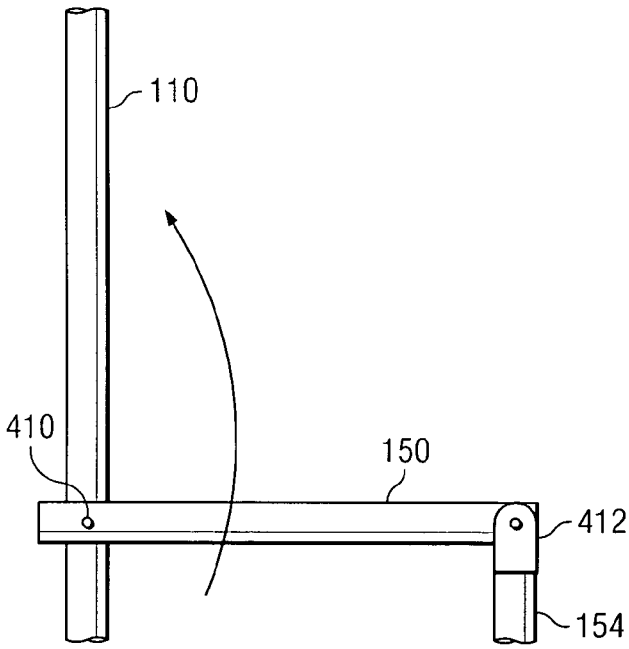
Figure 4D:
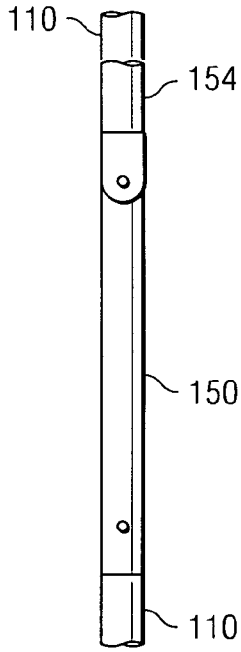

An alternate embodiment is illustrated in FIGS. 4*c* and 4*d*, wherein the protruding member 150 is pivoted on the outside of the downwardly extending leg 110 about a pivot pin 410 and the downwardly extending support member 154 is pivoted with a hinge 412 on the end of the protruding member 150. In operation, the downwardly extending support member 154 will rotate outward from the downwardly extending leg 110 such that it will be disposed along the longitudinal axis of the protruding member 150. The protruding member 150 then can be rotated upward to a position parallel to the outside of the downwardly extending leg 110, this is illustrated in FIG. 4*d*. In this manner, the protruding member 150 will be parallel to the outside of the downwardly extending leg 110 and it will not interfere with the cross member 102 when the workout apparatus is collapsed.

Figure 5:
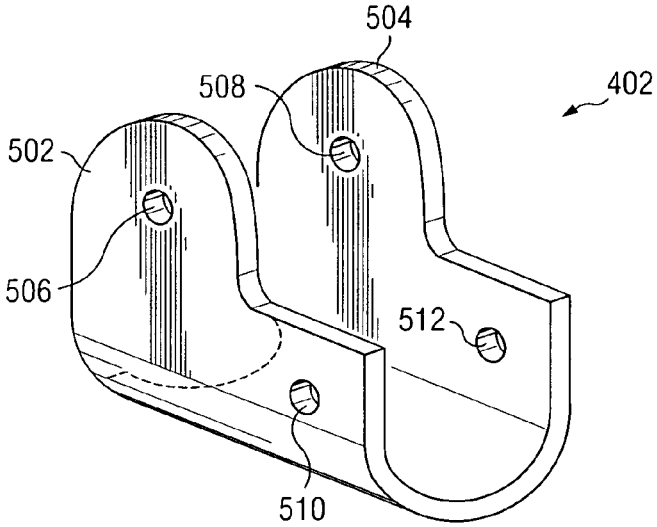
FIG. 5 illustrates a perspective view of a hinge utilized in the embodiment of FIGS. 4*a* and 4*b;*

Referring now to FIG. 5, there is illustrated a detail of the hinge 402, this being similar and substantially identical to the hinge 404. There are provided two flanges 502 and 504 that are operable to be wrapped about the outer surface on either side of the downwardly extending leg 110. There are provided two pivot holes 506 and 508 for receiving a pivot pin disposed through a hole in the downwardly extending leg 110. This hinge 402 will allow the protruding member 150 to rotate downward and stop when it is in the horizontal position, as there is an arcuate shaped surface below the two flanges 502 and 504 (not shown). The bottom surface of the hinge extending outward therefrom is a "trough" shape such that it will receive the proximate end of the outwardly protruding member 150 (tubular in shape) and there will be two holes 510 and 512 for attaching the hinge 402 to the proximal end of the protruding member 150.

Figure 6:
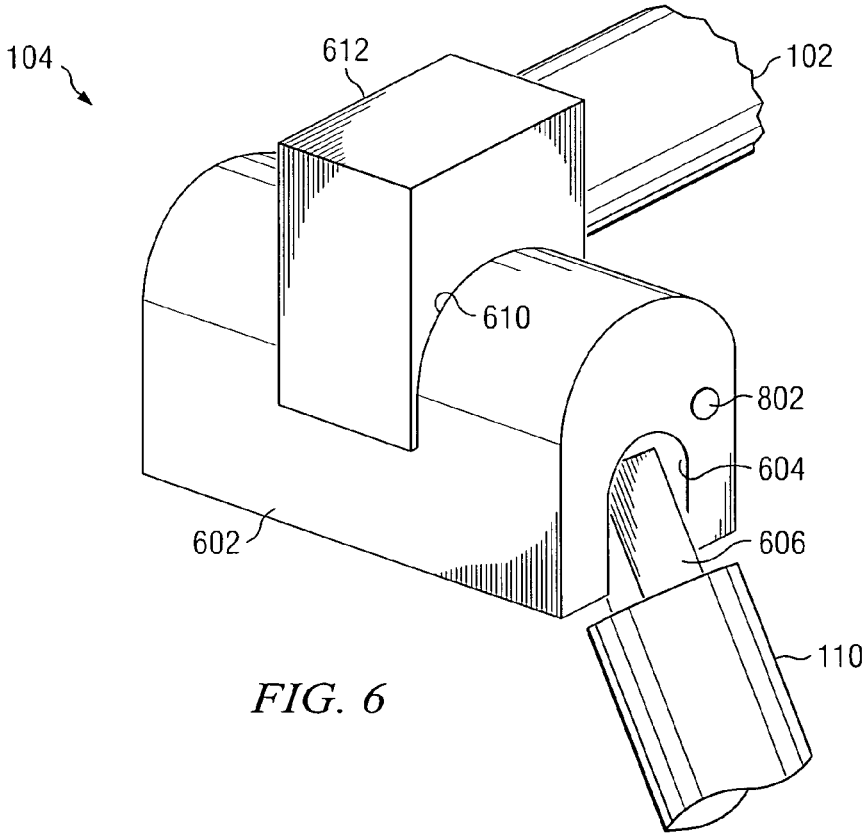
FIG. 6 illustrates a perspective view of the mechanism for supporting the two downward extending legs on each side of the workout apparatus.

Referring now to FIG. 6, there is illustrated a detail of the pivot member 104, which is similar to the pivot member 106. The pivot member 104 has associated therewith a main body 602. The main body 602 has disposed on either end thereof a recess 604. The recess 604 is operable to receive a pivoting member 606 of the downwardly extending leg 110 on one side thereof, with a similar pivoting member 606 disposed on the downwardly extending leg 108 (not shown). This pivoting member 606 is operable to pivot such that the downwardly extending leg 110 is able to be pivoted between a perpendicular and a flare position. The main body 602 has a pivoting well 610 disposed therein which is operable to receive a second pivoting body 612 that is attached to the end of the cross member 102. This pivot end is operable to allow the main body 602 to rotate with respect to the pivoting body 612 such that the main body 602 can pivot inward relative to the pivoting body 612, as will be described herein below.

Figure 7:
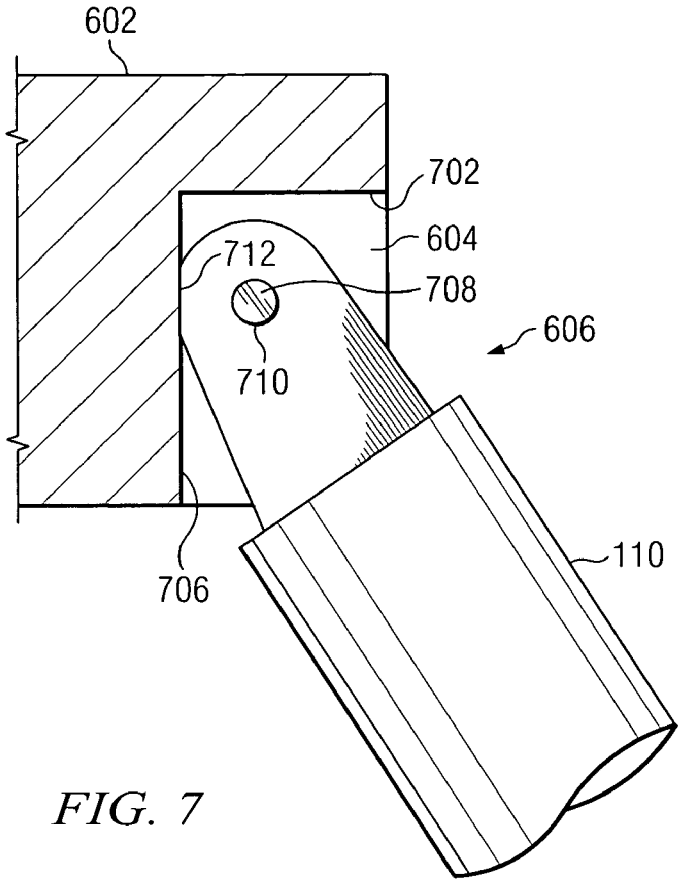
FIG. 7 illustrates a detail of the hinge mechanism for one of the downward extending legs.

Referring now to FIG. 7, there is illustrated a detail of the pivoting member 606 and a cutaway of the recess 604. The recess 604 is illustrated such that it has a top wall 702 and a back wall 706. The back wall 706 provides a stop function. A pivot pin 708 is disposed through a pivot hole 710 in the pivoting member 606. The pivoting end 606 has an arcuate shape from the upper end thereof with a flat surface 712 that is operable to interface with the back surface of the body 602. Therefore, the pivoting member 606 can pivot about the pivot pin 708 to a vertical position and then it can flare outwards until the flat surface 712 contacts the back wall 706 of the body 602, at which time the pivoting action will stop. However, if the brace 130 is not utilized, then an undue amount of stress can be placed on the pivot pin 708. Therefore, the primary force for restraining the outward pivoting of the downward extending leg members 108 and 110 is provided by the brace 130. Typically, the body 602 and the pivoting end 608 will be fabricated of a metal and the downwardly extending leg member could be fabricated from a different material such as polycarbonate. Note that the brace 130 could be nothing more than a cable.

Figure 8:
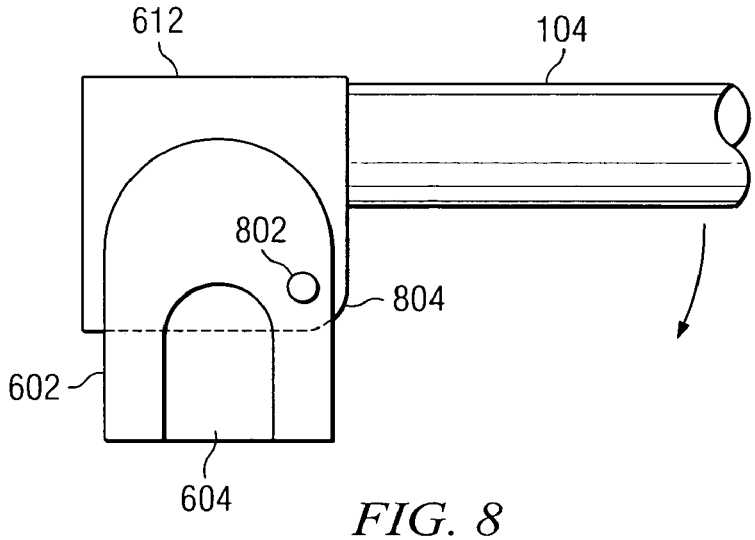
FIG. 8 illustrates a detail for the rotation of the legs toward the cross-bar member when collapsing the apparatus.

Referring now to FIG. 8, there is illustrated a detail of the pivoting relationship of the pivoting body 612 and the body 602. The bottom surface of the pivoting body 612 is illustrated in phantom and a pivot pin 802 is illustrated as being disposed through a portion of the lower inner corner of the pivoting body 612. The pivoting body 612 will have an arcuate surface 804 proximate to the pivot pin 802. Therefore, when the pivoting body 612 rotates about the pin 802 relative to the body 602, the interior side of the body 602 will pivot toward the bottom surface of the cross member 104.

What is claimed is:

1. A workout apparatus, comprising:

a crossbar member;

a first pivot device disposed on a first end of said crossbar member;

a second pivot device disposed on a second end of said crossbar member;

a first set of support legs comprising:

a first downwardly extending leg with one end thereof disposed in said first pivot device and pivotable therein, a second downwardly extending leg having a first end pivotably engaged with said first pivot device, said first and second downwardly extending legs operable to pivot from a substantially parallel relationship to each other to a non-parallel relationship in a diverging form, and a restraining device for restraining said first and second downwardly extending legs from diverging beyond a predetermined point;

a second set of support legs comprising:

a third downwardly extending leg with one end thereof disposed in said second pivot device and pivotable therein;

a fourth downwardly extending leg having a second end pivotably engaged with said second pivot device, said third and fourth downwardly extending legs operable to pivot from a substantially parallel relationship to each other to a non-parallel relationship in a diverging manner, a restraining device for restraining said third and fourth downwardly extending legs from diverging beyond a predetermined point;

said crossbar member and said first, second, third and fourth set of support legs structurally load bearing to support the weight of an individual suspended from said crossbar member with the distal ends of said first, second, third and fourth downwardly extending legs of said first and second supporting sets disposed on a flat surface;

a first protrusion extending from a pivot point proximate to but disposed a short distance from the end of said first leg of said first set of support legs, said first protrusion operable to pivot upward from a first position that is parallel to said crossbar member to a position that is substantially parallel to said first leg of said first set of support legs;

a second protrusion extending from a pivot point proximate to but disposed a short distance from the end of said third leg of said second set of support legs, said second protrusion operable to pivot upward from a first position that is parallel to said crossbar member to a position that is substantially parallel to said third leg of said second set of support legs;

said first and second protrusions in said first position extending toward each other from the respective one of said first and third legs in the respective one of said first and second sets of support legs.

2. The workout apparatus of claim 1 wherein the height of said crossbar member when said first, second, third and fourth legs of said first and second sets of support legs are pivoted outward is less than the height of a normal individual such that a normal individual laying on their back on the work surface on which the workout apparatus is disposed can substantially reach said crossbar member with outstretched arms.

3. The workout apparatus of claim 1 and further comprising:

a first support member disposed on the distal end of said first protrusion from said associated pivot point and directed downward toward and touching the work surface when said first protrusion is in said first position, said first support member having a length that is substantially equal to the distance that the distal end of said first protrusion is disposed above the work surface when said first protrusion is disposed in said first position; and a second support member disposed on the distal end of said second protrusion from said associated pivot point and directed downward toward and touching the work surface when said second protrusion is in said first position, said second support member having a length that is substantially equal to the distance that the distal end of said second protrusion is disposed above the work surface when said second protrusion is disposed in said first position.

4. The workout apparatus of claim 1, wherein said restraining device for each of said first and second sets of support legs comprises a tension member attached between points on said first, second, third and fourth downwardly extending legs at points substantially midway between the respective ends thereof and having a length equal to the maximum desired pivot position when said associated first, second, third and fourth legs are in an outwardly pivoted position.

5. The workout apparatus of claim 4, wherein said tension member comprises a brace comprised of first and second members, said first member pivotably attached to said respective first or third leg on one end thereof at the substantially midway point and said second member pivotably attached to substantially the midway point on said respective one of said second or fourth downwardly extending leg on one end thereof and the other end of said first and second members of said brace pivotably attached to a pivoting hinge point, wherein said hinge point is operable to pivot such that said pivot point joining said first and second members can move upward toward said associated first or second pivoting device or downward therefrom when said associated first and second or third and fourth downwardly extending legs are pivoted together to a parallel position and, when fully extended, said first and second members of said brace are in substantially the same plane to provide tension thereto.

6. The brace of claim 5, wherein said first and second members at the pivoting hinge point are "locked" with a locking hinge such that, when extended in a substantially parallel plane, a force is required to cause said first and second members to be retracted from a substantially parallel plane.

7. The workout apparatus of claim 1 wherein said first and second pivot members each comprise:

first and second pivot points for allowing said associated first and second or third and fourth downwardly extending legs to pivot in a common plane toward each other and away from each other; and a pivoting device for allowing said first and second or third and fourth legs, while pivoting in a common plane, to pivot in said common plane to a position substantially parallel to said crossbar member.

8. The workout apparatus of claim 1, wherein said first and second protrusions are weight bearing such that an individual facing downward to the work surface can grasp said first and second protrusions with the right and left hands of the individual, respectively, and support a substantial portion of the body weight of a normal individual thereon.

9. The workout apparatus of claim 8 wherein said first and second protrusions extend inward toward each other a sufficient distance such that an individual can grasp said first and second protrusions in such a manner that the individual's hands can be substantially aligned with the shoulders such that the hands can be brought to at least the shoulder width of the individual.

* * * * *